United States Patent [19]

Etheridge

[11] Patent Number: 4,909,449

[45] Date of Patent: Mar. 20, 1990

[54] PRIMARY CRUSHING STAGE CONTROL SYSTEM

[76] Inventor: Johnny E. Etheridge, 1744 Old Powhatan Estates Dr., Powhatan, Va. 23139

[21] Appl. No.: 322,334

[22] Filed: Mar. 10, 1989

[51] Int. Cl.[4] ..... B02C 9/04

[52] U.S. Cl. ..... 241/34; 241/36

[58] Field of Search ..... 241/33, 34, 36, 101.7

[56] References Cited

U.S. PATENT DOCUMENTS

| | | | |
|---|---|---|---|
| 4,281,800 | 8/1981 | Flavel | 241/34 X |
| 4,651,933 | 3/1987 | Schütte et al. | 241/34 |
| 4,706,893 | 11/1987 | Brock | 241/34 X |

*Primary Examiner*—Timothy V. Eley

*Attorney, Agent, or Firm*—Fay, Sharpe, Beall, Fagan, Minnich & McKee

[57] ABSTRACT

A first stage of a rock crushing plant is controlled by controlling the feed rate supplied to a primary rock crusher and by indicating to haul vehicles bringing rock to the plant from a quarry when the load being hauled can be dumped in to a hopper supplying the feeder for the primary rock crusher. Non-material contacting level sensors, such as ultrasonic transducers are used to sense the level of rock within the hopper and within the cavity of the rock crusher. Further, the load of the motor driving the primary rock crusher and the motor driving an output conveyor that receives the discharged rock from the primary rock crusher is monitored. The output signals from the level and load sensors are compared with preset values to adjust the feed rate of rock being delivered to the primary crusher in order to optimize the throughput of rock in the first crushing stage of the plant.

20 Claims, 2 Drawing Sheets

PRIMARY CRUSHING STAGE CONTROL SYSTEM

FIELD OF THE INVENTION

The invention relates to a system for controlling the first stage of a rock crushing plant.

BACKGROUND OF THE INVENTION

Rock that is removed from a quarry is typically hauled to a rock crushing plant. Within the rock crushing plant, there are usually three stages of crushing: primary crushing, secondary crushing, and tertiary crushing. Some of the rock removed from the quarry is of a sufficient size to enter the secondary and tertiary crushing stages directly. The remainder of the rock removed from the quarry must pass trough a primary crushing stage so that it is reduced in size, typically to 8 inches in diameter or less.

All of the rock removed from a quarry or other location is dumped by a hauling vehicle into a hopper or bin. This includes the rock that is already of a sufficient minimum size to be introduced into the secondary and tertiary crushing stages directly. The rock is emptied out of the hopper by a feeder across screening bars that allow the sufficiently small sized rock to pass through to a conveyer that transfers the smaller diameter rock to the other crushing stages in the plant. The remainder of the rock is fed to a primary crusher, such as a Jaw Crusher or a Gyratory Crusher.

The throughput of the primary crusher therefore governs the amount of rock that can be introduced into the secondary and later stages of crushing. Accordingly, when the primary crushing stage is unable to deliver enough rock to the secondary and later stages of crushing within the rock crushing plant, the overall efficiency of the plant is greatly reduced. Conversely, when the feeder of the primary crusher is operated at a flow rate that produces a large volume of crushed rock being discharged to an output conveyer, the output conveyer or other output side equipment becomes overloaded so the feeder rate needs to be decreased. If the output conveyer reaches an overloaded condition, then the motor driving the conveyer trips off in response to an overload prevention circuit. This creates unwanted down time and the likelihood of material spillage.

Ordinarily, an operator is required to regulate the feed rate of rock being supplied to the primary crusher and to supervise the dumping of rock into the hopper that is delivered by the haul vehicles returning from the quarry. The operator relies upon his experience to vary the feed rate in order to maintain a constant supply of rock to the primary crusher and to keep the hopper full without overfilling it. The output of the primary crusher, therefore, is controlled by the operator. The operator has no way to determine whether the first stage crushing operation is at optimum efficiency other than to depend on his experience in operating the equipment. Further, the operator usually runs the primary crusher feeder at a rate that prevents an unwanted overload from ever occurring, and thus also prevents the throughput of the primary crusher from ever reaching an optimum throughput.

It has been known to automate secondary and tertiary crushing stages in a rock crushing plant by controlling the feed rate of a feeder delivering rock to the secondary or tertiary crushers being used. For example, U.S. Pat. No. 4,804,148 discloses that control systems are known wherein a programmable logic controller has been used to vary the feed rate to a secondary or tertiary crusher in accordance with signals received from a horsepower sensor and level sensor so that an optimum feed rate for the conditions being sensed can be determined and set for the crusher feeder. According to the known methods, however, a material contacting level sensor is required to extend within the bowl of the crusher in order to determine the level of rock within the crusher bowl. The level sensing probe that has been used is of a design that is able to withstand the harsh environment encountered in a rock crushing bowl of a secondary or tertiary crusher material contacting level sensor. It is not known, however, to sense the level of rock within a crushing cavity for a primary crusher, because the rock that enters a primary crusher is much larger than the rock entering a secondary or tertiary crusher thus creating an even harsher environment for the level sensor. Accordingly, no attempts have been made to automate a primary crusher, so an operator has always been used to regulate the feed rate delivered to a primary crusher and to signal the driver of a haul vehicle when to dump his load.

SUMMARY OF THE INVENTION

It is an object of the invention to automate a primary crushing stage of a rock crushing plant in order to optimize the throughput of the primary crushing stage so that a maximum amount of rock is available for delivery to the secondary and later stages of crushing.

It is an object of the invention to provide an indicating system for a driver of a haul vehicle who intends to dump a load of rock into a hopper supplying rock to a primary crushing stage of a rock crushing plant.

It is an object of the present invention to automate the operation of primary rock crusher by controlling the feed rate of rock delivered to the crusher such that the throughput of the crusher is optimized and the output conveyer and other output side equipment is not overloaded by an excessive amount of crusher throughput. The other output equipment that should not be overloaded includes downstream screens, conveyors, and crushers for the secondary stage of crushing.

It is an object of the invention to automate the operation of a primary rock crusher by sensing the level of rock within the cavity of the rock crusher with a non-material contacting level sensing transducer by controlling the feed rate of rock delivered to the primary rock crusher so that a minimum level of rock within the cavity is maintained while a maximum level of rock within the cavity is not exceeded. It is a further object of the invention to maintain the feed rate within a desired range so that the load on an engine driving the primary crusher is maintained within an optimum efficiency range.

It is an object of the invention to provide an indication to a driver of a haul vehicle that the load of the haul vehicle can be dumped into the hopper by sensing the level of rock contained in the hopper with a non-material contacting level sensing transducer. The driver receives an indication that the load can be dumped when the level of rock within hopper is less than a predetermined level so that the load being dumped does not overfill the hopper.

It is an object of the invention to provide a control system for indicating to an operator of a haul vehicle when the load of the haul vehicle can be dumped into a hopper and for controlling the feed rate of a feeder delivering rock from the hopper to a primary rock crusher in accordance with the load placed on the motor driving the output conveyer such that the load on the output conveyer motor doe not exceed a predetermined amount that corresponds to a load placed on the motor when the maximum material handling capacity of the conveyer is reached. It is a further object to run the feeder of the crusher while monitoring other first stage crushing halting conditions that when sensed command the feeder to stop. The feeder is commanded to stop by the control system, for example, when the level sensed within the hopper is less than a predetermined amount so that the hopper is never emptied by the feeder. The control system further commands the feeder to stop when conditions such as a plugged chute, insufficient primary lubrication for the primary crusher and other like conditions are sensed that would cause spillover or damage to the rock crushing equipment.

DETAILED DESCRIPTION OF THE PREFERRED EMBODIMENT

Figure 1:
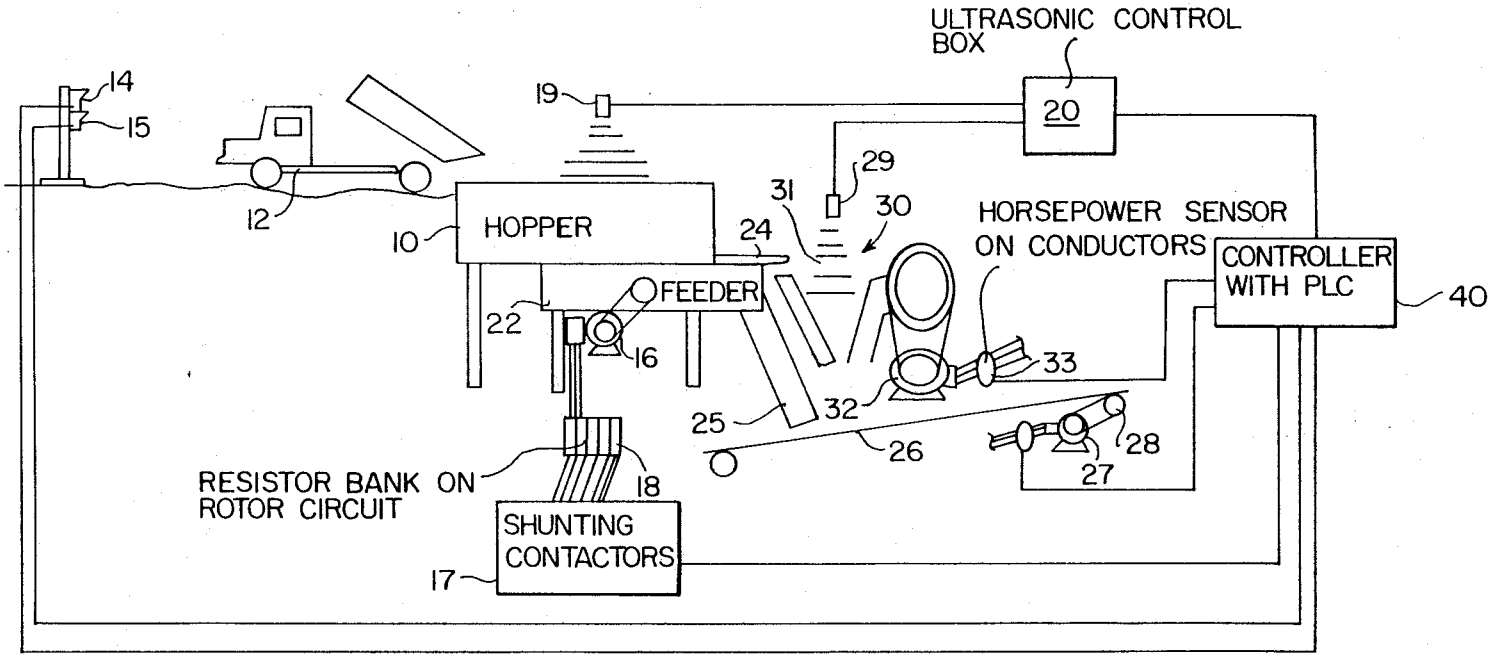
FIG. 1 is a diagram of the control system of the invention applied to a primary crushing stage of a rock crushing plant.

FIG. 1 shows a diagram of a typical first crushing stage in a rock crushing plant. A hopper 10 is provided for receiving rock from a haul vehicle 12 that is brought to the plant from a quarry. Ordinarily, a driver does not leave the vehicle to determine whether or not the hopper will hold the load he is hauling because it is to dangerous, so a plant operator informs the driver about whether the hopper can hold the load. By the present invention, lights 14 and 15 are provided to visually indicate to the driver whether or not the load can be dumped into the hopper so the need for an operator is obviated. Of course, other suitable ways of signaling the driver that a load can be dumped may be provided that include, for example, providing audible signals or a movable gate in front of the hopper. Lights 14 and 55 are shown for purposes of illustrating a preferred embodiment of the invention, but only one light is sufficient to indicate either a dump or no-dump condition. Lights 14 and 15 are shown as green and red lights respectively to indicate the dump and no-dump conditions.

The signaling of the lights 14 and 15 is controlled by controller 40 in accordance with the level of rock sensed within hopper 10 by a level sensor 19. When the level of rock within the hopper is less than a predetermined level such that a load of rock can be dumped into the hopper without risking overfilling the hopper, then the appropriate light 14 is illuminated to indicate to the driver of the haul vehicle that a dump condition is present.

Level sensor 19 is a non-material contacting level sensor, and any type of non-material contacting level sensor can be used to determine the level of rock within the hopper. Preferably, level sensor 19 is an ultrasonic transducer that receives an echo that is proportional in time to the distance between the face of the transducer and the average level of rock within the hopper. An ultrasonic control box 20 is provided to compare the signal of the ultrasonic transducer with a preset value that corresponds with the level that allows for dumping of another load of rock into the hopper. The value of the ultrasonic transducer signal increases as the level of rock is lowered because the distance between the transducer and the rock level increases as the hopper is emptied. When a comparison shows that the signal of the ultrasonic transducer exceeds the preset value, then controller 40 lights the dump light 14, otherwise the no-dump light 15 is illuminated. Also, the controller 40 commands the feeder 22 to stop when the output signal of transducer 19 exceeds a value representing a near empty load of hopper 10.

The rock brought from the quarry is dumped into the hopper and fed to a primary crusher 30 by a feeder 22. Some of the rock within the hopper will be of a sufficiently small size in diameter so that is does not need to be crushed in primary crusher 30, so feeder 22 has screening bars 24 that allow the smaller sized rock to fall out from the feed path and slide down chute 25 onto an output conveyer 26. The rock that is crushed within primary crusher 30 is discharged onto output conveyer 26. The rock traveling on conveyer 26 is transported to the secondary and later stages of crushing in the rock crushing plant.

The amount of rock delivered by conveyer 26 to the secondary and later stages of crushing in the rock crushing plant depends upon the amount of rock dumped into hopper 10 and crushed in primary crusher 30. Accordingly, the control system of the invention is provided to maintain the hopper in a full state by providing an indication of when rock can be dumped into the hopper and to keep the cavity 3 of the primary crusher full with rock as well by keeping the load on motor 32 driving the primary crusher within a predetermined optimum efficiency range. Further, in order to deliver the most rock to the later stages of rock crushing, the output conveyer must be kept running at a maximum capacity.

To sense the level of rock within cavity 31 of the primary crusher, a non-material contacting level sensor 29 is provided that, like level sensor 19, is preferably an ultrasonic level sensing transducer. Level sensor 19 is shown as being connected to the ultrasonic transducer control box 20. The output of the transducer 29 also increases as the rock level goes down in the cavity. As a result, the feeder rate is increased when the output signal of transducer 29 exceeds a first set value, representing minimum cavity capacity and the feeder rate is decreased when the output signal is less than another preset value representing a maximum cavity capacity of crusher 30. Also, a load sensor 33 is provided on the conductor supplying the power for motor 32 in order that the load on the motor can be monitored. The level of rock within the cavity 32 and the horsepower load on motor 32 are received as inputs by controller 40.

Figure 2:
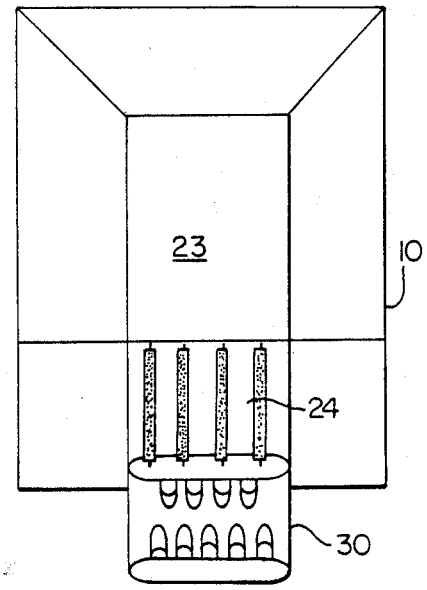
FIG. 2 is a schematic top view of a hopper, feeder and primary crusher of a first crushing stage of a rock crushing plant.

Feeder 22 is, for example, a Grizzly vibrating feeder that s driven by a motor 16, which is of variable speed. The feeder is positioned at the bottom of the hopper, as shown in FIGS. 1 and 2. The feeder pan 23 is shown in FIG. 2. The feeder has a variable feed rate that is controlled by changing the speed of motor 16. It is necessary to control the speed of the motor driving the feeder to control the material flow rate into the primary crusher. Another factor to consider is if the motor setting remains constant, then the feed rate being delivered to the crusher will vary depending upon the level of rock within the hopper and the ratio of small and large diameter rocks within the hopper.

FIG. 1 shows that a typical motor for driving a primary crusher feeder is a wound rotor motor having grid resistors 18 in the rotor circuit and a drum switch for varying the resistance in the rotor circuit (not shown). In order to vary the resistance in the rotor circuit by using controller 40, the drum switch is connected in parallel with a plurality of shunting contactors 17, which are opened and closed progressively to provide the same result as achieved by a drum switch. Alternatively, the feeder may be driven by a motor that is controlled by a potentiometer or rheostat, which can be driven by a low RPM motor. On existing equipment, the controls for varying the speed of the motor driving the feeder are intended for operation by a plant operator, and these controls may vary from plant to plant. Any suitable method therefore, for controlling the existing variable feed rate controls that are provided with the equipment can be used to implement the control system of the invention. The circuit including shunting contractors 17 is shown as a preferred embodiment for controlling the speed of a wound rotor motor through a programmable logic controller, such as controller 40.

In order to maintain a maximum supply of rock for the later crushing stages, the load on motor 27 that drives output conveyer 26 is monitored by a load sensor 28. An indication of whether or not the feed rate can be increased without exceeding the maximum capacity of the conveyer can be determined by comparing the sensed load on motor 27 to a preset value representing the maximum load the motor can handle without reaching an overload condition that causes the motor to trip off. If the load on the motor has not reached the maximum operating range, then the feed ate can be increased. Ordinarily, a plant operator would hesitate to increase the feed rate to the crusher for fear of overloading the output conveyer, but as a result of controlling the feed rate while monitoring the load on motor 27, the risk of overloading the conveyer is overcome, and the throughput of the primary crushing stage is greatly increased.

Under certain conditions, it is necessary to stop the feeder 22, so controller 40 is provided with additional inputs that monitor various conditions that might need to be monitored depending upon the specific equipment and installation. For example, the lubrication system for the primary crusher can be monitored in order to determine whether or not the crusher is adequately lubricated. The lubrication system can be monitored by using a pressure transducer in the lubricant flowpath, for example. In this case, however, should the lubrication system fail, then the feeder and the primary crusher would both be turned off.

Figure 3:
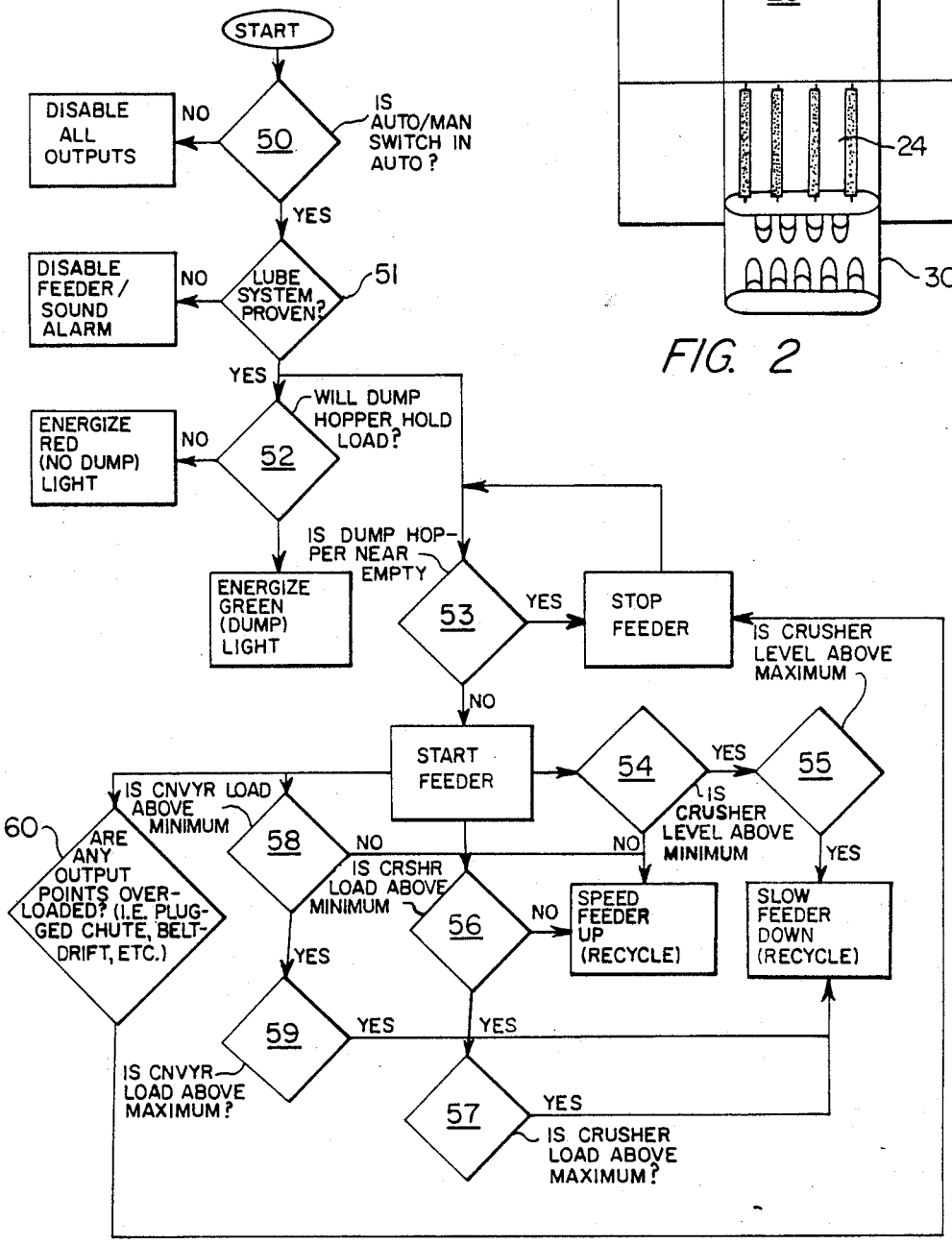
FIG. 3 is a flow chart showing the operation of the control system of the invention.

FIG. 3 shows a flow chart of the operation of the control system of the present invention. The control system is designed to be used as an alternative to the manual control system that is provided on existing equipment. Therefore, at a first step 50, the determination is made whether or not the automatic/manual mode switch is in the automatic mode. If it is not, then the control system disables all of the controlled outputs so that manual operation can be exercised over the equipment. If the automatic mode has been selected, then the controller 40 determines whether or not any externally monitored control systems, such as the lubrication system for the primary crusher, are not in condition for supporting operation of the equipment. If any of the monitored conditions are not ready to support operation of the system, then the feeder is disabled and an alarm is sounded at step 51. Otherwise, the controller proceeds to a step 52 to determine whether the hopper 10 will hold a load by comparing the hopper level sensor 19 with a preset level that is determined in accordance with the size of the hopper and the size of the dump body of the haul vehicles supplying the rock. If the hopper will hold the load, then light 14 is illuminated to indicate a dump condition, but if the hopper will not hold a load then light 15 is illuminated to indicate a no-dump condition.

If the hopper is not near empty, then the feeder 22 and primary crusher 30 are started. The control system continues to monitor the dump hopper level, energizing the dump and no-dump lights respectively and further monitors the dump hopper level in step 53 to determine whether the level of the hopper is below a predetermined level or near empty. If the dump hopper is nearly empty, then the feeder is stopped so that a minimum level of rock is maintained within the hopper. In this way, when another load of rock is dumped into the hopper, the remaining layer of rock buffers the impact of the dumped load so that a minimum amount of damage occurs to the bottom of the hopper and bottom feeder pan 23.

If the dump hopper is not near empty, then the feeder is started and the level of rock within crusher cavity 31 is monitored by level sensor 29 at a step 54. If the level of rock within the crusher cavity 31 is below a preset minimum level, then the feeder rate is increased. If the crusher level is above a minimum preset level, the control system further determines whether the crusher level is above a maximum preset level at step 55. If it is, then the feed rate of the feeder 22 is slowed down. The maximum an minimum levels are set as desired to establish an efficient working range.

At the same time the rock level in the crusher cavity 31 is monitored, the load of motor 32 driving the primary crusher is monitored through load sensor 33. First, the controller 40 determines at a step 56 whether the load of motor 32 is above a minimum desired operating level. If it is not, then the feeder rate is increased. If it is, then the controller 40 is further programmed to determine whether or not the load of motor 32 is above a maximum preset level as step 57. If it is above the maximum level, then the feeder is commanded to slow down the feed rate.

An additional condition being monitored is the load of output conveyer motor 27. At a step 58, the controller compares the signal from load sensor 28 to a predetermined minimum operating range value and commands the feeder to increase the feed rate to the crusher if the load on motor 27 is below the preset value. If the load is within the operating range, then at step 59 the load signal is compared to another preset value representing the maximum load within the desired working range. The feeder is commanded to decrease the feed rate if the load signal exceeds the maximum preset value. Otherwise, the feeder continues to run within the established working range.

By presetting maximum and minimum operation levels of rock within the crusher cavity 31 and maximum and minimum loads on the crusher motor 32 and the output conveyer motor 27, the primary crusher 30 is operated in an optimum range of efficiency without the need for an operator to vary the feed rate of feeder 22. Further, controller 40 can receive other inputs from transducers monitoring external conditions at a step 60 to determine whether or not the monitored conditions exceed a desired level that requires the feeder to be stopped. For example, the controller decides at step 58 whether or not chute 25 is clogged or whether or not excessive belt drift is occurring in conveyer belt 26, or other belts. If any of these conditions exists, then the feeder is stopped or slowed down depending on the severity of the problem and the likelihood of the problem to cause damage to the equipment or to cause spillage. Controller 40 is preferably programmable to set the maximum and minimum levels that are desired for the level of rock within crusher cavity 31, and the maximum and minimum load levels for the crusher motor 32 and conveyer motor 27. Further, the controller can be programmed to accept a variety of inputs for comparing the inputs to set values in order to determine whether or not the crushing system is working properly. In this way, the need for an operator is reduced from a full-time need to a part-time need, and the required experience level of the operator is reduced while the efficiency of the primary crushing stage of the plant is optimized.

It can be appreciated that the foregoing invention can be practiced by substituting other non-material contacting level sensors for the ultrasonic transducers disclosed and by substituting other types of indicating systems for the lights that are disclosed without departing from the scope of the invention. Further, other equipment on the output side of the primary crusher can be monitored other than the output conveyer, such as screens and feeders in the secondary crushing stage of the plant. Accordingly, the invention may be practiced within the scope of the spirit of the appended claims.

I claim:

1. A control system for a primary rock crushing stage of a rock crushing plant, comprising:

a primary rock crusher having a cavity for receiving rock, jaws for crushing the rock, and an outlet for discharging the crushed rock;

hopper means for storing rock to be crushed by said primary crusher, said hopper means having an opening for receiving rock from a dumping body;

feeder means for feeding rock stored in said hopper to said primary crusher at a variable rate;

first feeder control means for driving said feeder at a predetermined rate in response to a received command signal;

first level sensing means for sensing the level of rock in said hopper without contacting said rock and outputting a first level signal having a value representing the level of rock in said hopper;

second level sensing means for sensing the level of rock in the cavity of said primary crusher without contacting the rock and outputting a second level signal having a value representing the level of rock in said cavity;

first means for indicating a dump condition to an operator of a dumping body that the load contained in the dumping body can be dumped into said hopper; and second control means for receiving said first and second level signals and for commanding said first feeder control means and said indicating means, including means for comparing the value of said first and second level signals with predetermined reference values whereby said second control means commands said indicating means to indicate a dump condition when the value of said first level signal exceeds a first one of said predetermined reference values and to increase the speed of said feeder means when the value of said second level signal exceeds a second one of said predetermined reference values.

2. A primary crushing stage control system according to claim 1, further comprising:

means for indicating to an operator a no-dump condition and said second control means commanding said indicating means for indicating a no-dump condition when the value of said first level signal is less than said first predetermined reference value.

3. A primary crushing stage control system according to claim 2, wherein said second control means commands said first control means to slow said feeder when the value of said second level signal is less than a third predetermined reference value, said third predetermined reference value being a maximum cavity capacity reference signal.

4. A primary crushing stage control system according to claim 3, wherein said second control means commands said first feeder control means to stop said feeder when the value of said first level signal is more than a fourth predetermined reference value, said forth predetermined value being a minimum hopper level reference value.

5. A primary crushing stage control system according to claim 2, wherein said means for indicating a no-dump condition includes a red light.

6. A primary crushing stage control system according to claim 1, wherein said second control means commands said first control means to slow said feeder when the value of said second level signal is less than a third predetermined reference value, said third predetermine reference value being a maximum cavity capacity reference value.

7. A primary crushing stage crusher control system according to claim 1, further comprising:

said primary crusher having a motor for driving the crusher;

a load sensor for detecting the load of said motor driving the crusher and outputting a load signal; and said second control means receiving said load signal and said comparing means comparing the value of said load signal with a first predetermined load reference value whereby said second control means commands said first feeder control means to increase the speed of said feeder when the value of said load signal is less than said first predetermined load reference value.

8. A primary crushing stage control system according to claim 7, wherein said second control means commands said first feeder control means to slow said feeder down when the value of said load signal exceeds a second predetermined load reference value.

9. A primary crushing stage control system according to claim 1, wherein said level sensors are ultrasonic transducers, and further wherein said first ultrasonic transducer is positioned above said hopper opening and said second ultrasonic transducer is positioned above said cavity of said primary crusher so that said first and second level signals are proportional to the distance between said first and second ultrasonic transducers and the level of rock being sensed respectively.

10. A primary crushing stage control system according to claim 1, further comprising:

an output conveyer for receiving rock discharged from said primary crusher;

a motor for driving said output conveyer and a load sensor for sensing the load on said conveyer motor and outputting a second load signal; and said second control means having means for receiving said second horsepower signal and comparing said second horsepower signal to a predetermined conveyer motor horsepower reference value, and commanding said first feeder control means to stop said feeder if said second horsepower signal exceeds said conveyer horsepower reference value.

11. A primary crushing stage control system according to claim 1, wherein said means for indicating a dump condition includes a green light.

12. A primary crushing stage control system according to claim 1, wherein said second control means commands said first feeder control means to stop said feeder when the value of said first level signal is more than a fourth predetermined reference value, said forth predetermined value being a minimum hopper level reference value.

13. A control system for a primary rock crushing stage of a rock crushing plant, comprising:

a primary rock crusher having a cavity for receiving rock, jaws for crushing the rock, and an outlet for discharging the crushed rock;

hopper means for storing rock to be crushed by said primary crusher, said hopper means having an opening for receiving rock from a dumping body;

feeder means for feeding rock stored in said hopper to said primary crusher at a variable rate;

first feeder control means for driving said feeder at a predetermined rate in response to a received command signal;

first level sensing means for sensing the level of rock in said hopper without contacting said rock and outputting a first level signal having a value representing the level of rock in said hopper;

means for indicating a dump condition to an operator of a dumping body that the load contained in the dumping body can be dumped into said hopper;

an output conveyor for receiving rock discharged from said primary crusher;

a motor for driving said output conveyor and a load sensor for sensing the load on said conveyor motor and outputting a load signal;

second control means for receiving said first level signal and said load signal and for commanding said first feeder control means and said indicating means, including means for comparing the value of said first level signal and said load signal with predetermined reference values whereby said second control means commands said indicating means to indicate a dump condition when the value of said first level signal exceeds a first one of said predetermined reference values and commands said first control means to increase the speed of said feeder means when the value of said load signal is less than a second one of predetermined reference values.

14. A primary crushing stage control system according to claim 13, further comprising:

second level sensing means for sensing the level of rock in the cavity of said primary crusher without contacting the rock and outputting a second level signal having a value representing the level of rock in said cavity;

and said second control means having means for receiving said second level signal and for comparing said second level signal with a third predetermined reference value, and said second control means commanding said first feeder control means to increase the speed of said feeder means when the value of said second level exceeds said third of said predetermined reference values.

15. A primary crushing stage control system according to claim 14, wherein said level sensors are ultrasonic transducers and further wherein said first ultrasonic transducer is positioned above said hopper opening and said second ultrasonic transducer is positioned above said cavity of said primary crusher so that said first and second level signals are proportional to the distance between the first and second ultrasonic transducers and the level of rock being sensed respectively.

16. A primary crushing stage control system according to claim 13, further comprising:

said primary crusher having a motor for driving the crusher;

a second load sensor for detecting the load of said motor driving the crusher and outputting a second load signal; and said second control means receiving said second load signal and said comparing means comparing the value of said second load signal with a fourth predetermined reference value whereby said second control means command said first feeder means to increase the speed of said feeder when the value of said second load signal is less than said fourth predetermined reference value.

17. A primary crushing stage control system according to claim 13, wherein said means for indicating a dump condition includes a green light.

18. A primary crushing stage control system according to claim 13, further comprising:

means for indicating to an operator a no-dump condition and said second control means commanding said indicating means to indicate a no-dump condition when the value of said first level signal is less than said first predetermined reference value; and said means for indicating a dump condition being a green light, and said means for indicating a no-dump condition being a re light.

19. A control system for a primary rock crushing stage of a rock crushing plant, comprising:

a primary rock crusher having a cavity for receiving rock, jaws for crushing the rock, and an outlet for discharging the crushed rock;

hopper means for storing rock to be crushed by said primary crusher, said hopper means having an opening for receiving rock from a dumping body;

feeder means for feeding rock stored in said hopper to said primary crusher at a variable rate;

first feeder control means for driving said feeder at a predetermined rate in response to a received command signal;

means for handling the rock discharged from said primary crusher;

a motor for driving said handling means and a load sensor for sensing the load on said motor and outputting a load signal;

second control means for receiving said load signal and for commanding said first feeder control means and including means for comparing the value of said load signal with a predetermined reference value whereby said second control means commands said first control means to increase the speed of said feeder means when the value of said load signal is less than said predetermined reference value.

20. A first stage crushing control system according to claim 19, wherein said handling means is an output conveyor, said comparing means further compares said load signal to a second predetermined reference value and said second control means further commands said first control means to slow the speed of said feeder means, when the value of said load signal exceeds second predetermined reference value.

* * * * *